US005253603A

United States Patent [19]

Mascolo

[11] Patent Number: 5,253,603

[45] Date of Patent: Oct. 19, 1993

[54] UNDERWATER VEHICLE MUFFLER

[75] Inventor: Ralph P. Mascolo, Newport, R.I.

[73] Assignee: Hughes Aircraft Company, Los Angeles, Calif.

[21] Appl. No.: 911,445

[22] Filed: Jul. 10, 1992

[51] Int. Cl.[5] ..... F42B 19/00

[52] U.S. Cl. ..... 114/20.1; 181/235; 181/267; 440/89

[58] Field of Search ..... 181/0.5, 115, 227, 235, 181/267, 282; 114/20.1, 20.2; 440/89, 113

[56] References Cited

U.S. PATENT DOCUMENTS

| | | | |
|---|---|---|---|
| 675,830 | 6/1901 | Gray | 181/55 |
| 2,807,329 | 9/1957 | Caldwell | 181/55 |
| 3,561,561 | 2/1971 | Trainor | 181/55 |
| 4,213,414 | 7/1980 | Sato et al. | 181/249 |

*Primary Examiner*—J. Woodrow Eldred

*Attorney, Agent, or Firm*—Wanda K. Denson-Low

[57] ABSTRACT

A muffler for use with an underwater vehicle. The muffler is mechanically attached to an exhaust tube or aft end of the underwater vehicle and has an hydrodynamic shape and perforated exterior that results in the production of less noise by the vehicle. Large bubbles have been determined to be offensive due to lower frequency collapsing noise which produces a louder vehicle exhaust. The present invention is perforated with holes to break up the flow of exhaust gas from the vehicle into small diameter bubbles that are emitted into the water. The present invention has a contoured outer wall that matches the contour of the underwater vehicle to provide for the hydrodynamic flow of water around the vehicle as it is propelled through the water. The present invention eliminates hydrodynamic voids at the aft end of the vehicle that would normally allow smaller bubbles to coalesce into large bubbles.

7 Claims, 2 Drawing Sheets

UNDERWATER VEHICLE MUFFLER

BACKGROUND

The present invention relates generally to underwater vehicles, and more particularly, to a muffler for use with such underwater vehicles.

It is generally well-known that a disadvantage of conventional exhaust valves for use in underwater vehicles is that their exhaust emission geometry allows hydrodynamic voids to be formed that that induce large bubbles and create noisier exhaust emissions. Also, some propulsion efficiency may be lost due to scattering of the propulsor thrust around a flow obstructing valve geometry.

Accordingly, it is an objective of the present invention to provide for an underwater vehicle muffler that reduces the exhaust noise emission of underwater vehicles. It is a further objective of the present invention to provide for a muffler for use with an underwater vehicle that improves propulsion efficiency of the underwater vehicle.

SUMMARY OF THE INVENTION

In order to achieve the above and other objectives, the present invention comprises a muffler for use with an underwater vehicle. The muffler includes an exhaust valve having relatively large openings disposed in an outer wall thereof that permit exhaust gas to flow therethrough. The large openings in the exhaust valve permit the free flow of gas therethrough. A contoured member is secured to the aft end of the vehicle or exhaust valve that has an exterior contour that matches the contour of the vehicle. The contoured member provides for hydrodynamic flow of water around the vehicle as it is propelled through the water. The contoured member has a plurality of relatively small openings in its periphery (that form a strainer) that cause the formation of relatively small bubbles caused by the exhaust gases that escape therefrom and flow around and past the vehicle. Consequently, when the small bubbles eventually collapse, they produce higher frequency tones and thus create less audible noise.

Propellors, or the like, are generally used to propel the underwater vehicle through the water. The exhaust gas is a byproduct of the combustion process that drives the propellers and must be expelled from the vehicle. The wash from the propellors (prop wash) flows over the strainer and the exhaust gas has mixes with the prop wash in the manner described above to form the relatively small bubbles.

More particularly, in its simplest form, the present invention is a muffler that mechanically attaches to an exhaust tube of an underwater vehicle. The present invention is perforated with holes to break up the exhaust gas flow of the vehicle into small diameter bubbles that are emitted into the water. The unique difference between present invention and conventional mufflers (exhaust valves) is that present invention eliminates hydrodynamic voids at the aft end of the vehicle that would normally allow bubbles to coalesce into larger bubbles. Large bubbles have been determined to be offensive due to lower frequency collapsing noise which produces a louder vehicle exhaust.

Underwater sound due to collapsing bubbles is proportional to bubble diameter, and exhaust emissions having smaller bubbles produces an exhaust noise that is more readily attenuated and is not as audible as exhaust gas that contains larger bubbles. The present invention provides for a geometry that fills the voids with metal, and thus produces small bubble emissions. Any propulsion system that requires gas to be distributed quietly in underwater applications can benefit from the present invention.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
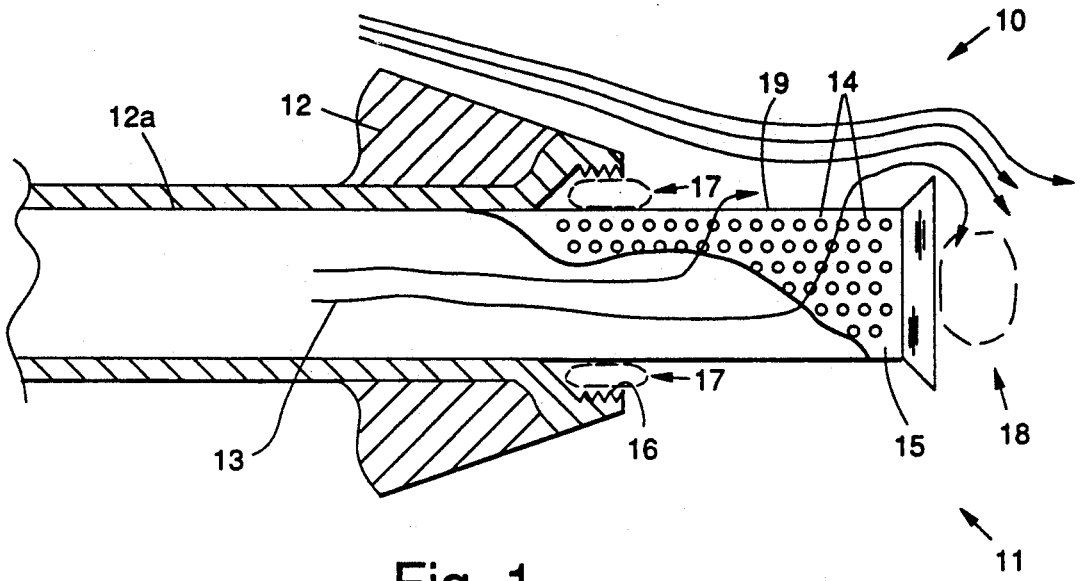
Fig. 1 (PRIOR ART)
FIGS. 1 and 2 show conventional exhaust valves that illustrate the problems that are solved by the present invention.
Figure 2:
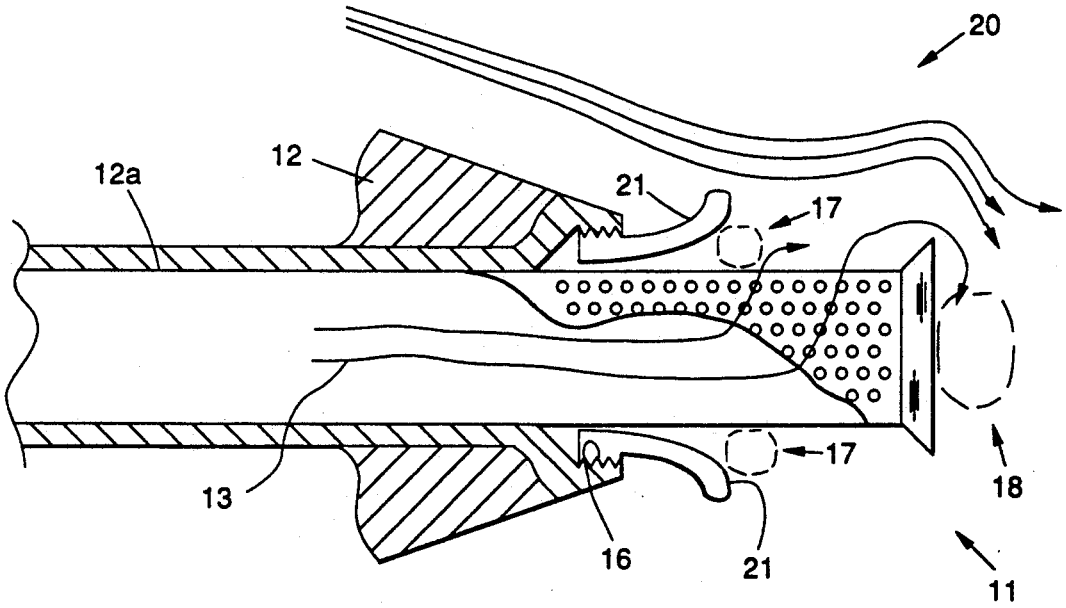
Fig. 2 (PRIOR ART)

Referring to the drawing figures, FIGS. 1 and 2 show conventional exhaust valves 10, 20 that illustrate the problems that are solved by the present invention. FIG. 1 depicts the geometry a first conventional exhaust valve 10 used in an underwater vehicle 11. The underwater vehicle 11 is comprised of an outer housing 12 that has an internal drive shaft **12*a* through which exhaust gas 13 is expelled towards the aft end thereof. The exhaust valve 10 is disposed at the aft end of the housing 12 and comprises an exhaust tube 19 having a plurality of openings 14 disposed around the periphery of its outer wall 15. Exhaust gas 13 escape through the openings 14 and flow past the exterior portion of the exhaust valve 10**.

Located at the rear end of the housing 12 is a threaded hole 16 whose threads are separated a short distance from the outer wall 15 of the exhaust valve 10. The area adjacent the threaded hole 16 forms a void 17 into which escaping bubbles flow and ultimately coalesce into a larger bubbles that eventually grow to such a size that they erupt and enter the flow as a larger bubble. In addition the aft-most portion of the exhaust valve 10 has a relatively flat surface that is oriented orthogonal to the direction of motion of the underwater vehicle 11. The area behind this aft-most portion also forms a void 18 into which escaping bubbles flow and ultimately coalesce into a larger bubbles.

More specifically, water flow passing over an opened valve 10 creates hydrodynamic voids in the cavities formed at the locations of the voids 17, 18. The exhaust gases 13 emitted through the small openings 14 in the valve 10 are free to enter into the voids 17, 18 and ultimately escape as a large bubble. This process then repeats as the underwater vehicle 11 is propelled through the water.

FIG. 2 shows the geometry a second conventional exhaust valve 20 and specifically illustrates the exhaust valve 10 which has a bell mouth adapter 21 installed in the threaded hole 16 of the underwater vehicle 11. The geometry of this exhaust valve 20 also creates voids 17, 18 and the geometry of this valve 20 may also act like a trumpet which increases exhaust sound.

It is apparent that the two conventional exhaust valves 10, 20 and underwater vehicle 11 into which they are installed have what may be considered relatively unacceptable noise characteristics. The noise characteristics of these valves are improved by the present invention.

Figure 3:
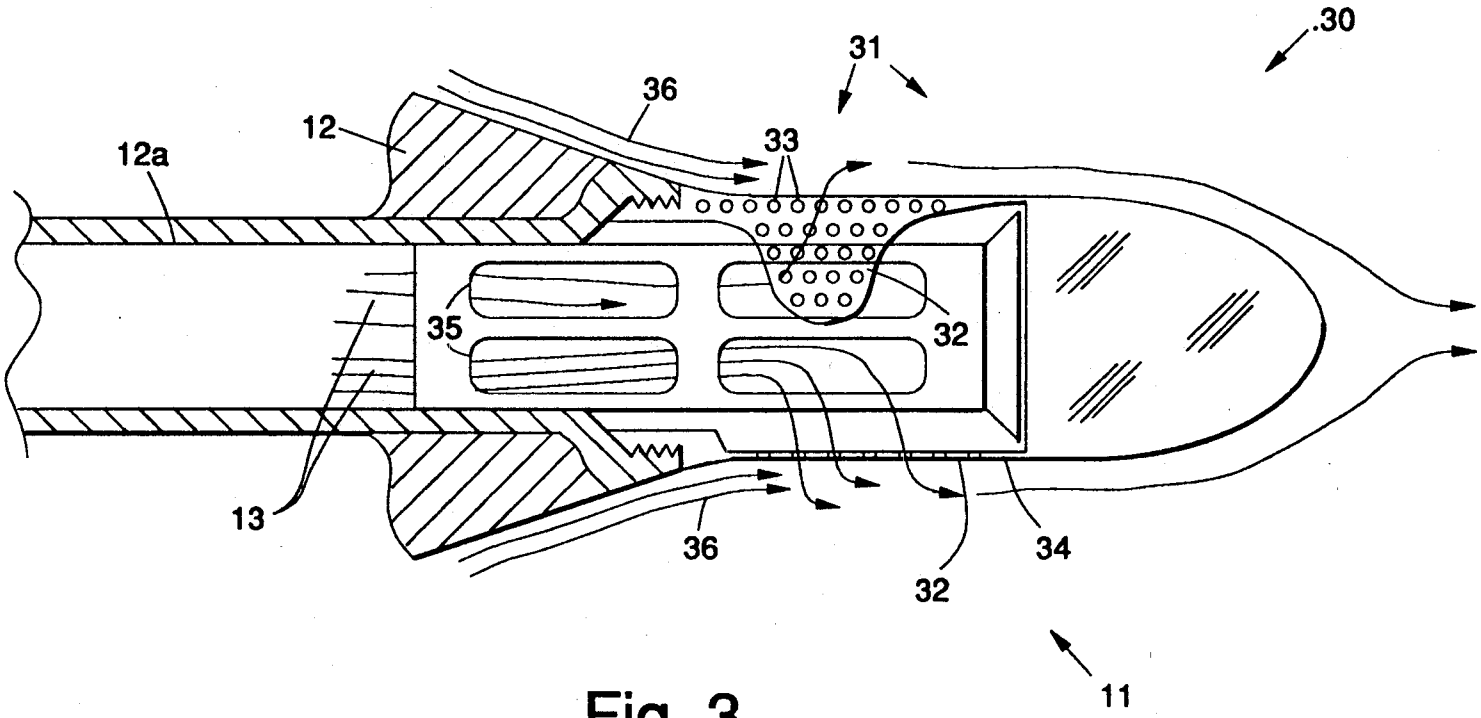
FIG. 3 shows the improved exhaust valve of the present invention and illustrates the improved noise characteristics thereof.

FIG. 3 shows an improved exhaust valve 30 of the present invention and illustrates the improved noise characteristics thereof. For the purposes of illustration, FIG. 3 shows a modified version of the exhaust valve 10 shown in FIG. 1. The exhaust valve 30 has relatively large passages 35 therethrough. The exhaust valve 30 present invention is comprised of a muffler 31 including a strainer 32, that may be formed from stainless steel, for example, having a plurality of relatively small openings 33 disposed in its peripheral wall 34 that is fastened to the housing 12 or exhaust valve 10 of the conventional underwater vehicle 11. Other materials such as aluminum, for example, may also be used to fabricate the strainer 32. The size of the openings 33 may be on the order of from 0.032 to 0.160 inches in diameter.

The muffler 31 may be fastened to the housing 12 or exhaust valve 10 by using the existing threaded hole 16 that is provided in the exhaust valve 10. It is to be understood that the use of the existing threaded hole 16 is only one way in which the muffler 31 of the present invention may be installed in the underwater vehicle 11. Those skilled in the art may employ a multiplicity of ways and means to secure the present invention to an existing underwater vehicle 11. Therefore, the manner in which the present invention is secured to the underwater vehicle 11 should not be considered as limiting to the invention.

Also, unique to the present invention is the contoured shape of the muffler 31 which has an exterior contour that matches the contour of the underwater vehicle 11 and provides for hydrodynamic flow of water around the underwater vehicle 11 as it is propelled through the water. Thus, by streamlining the hydrodynamic flow behind the underwater vehicle 11, propulsion efficiency is enhanced. The thrust is able to flow aft without obstruction.

With regard to the operation of the muffler 31 of the present invention shown in FIG. 3, the voids 17, 18 present in the conventional exhaust valves 10, 20 are eliminated and exhaust gasses 13 have no choice but to enter the water stream through the small openings 33 in the peripheral wall 34 of the muffler 31 and be carried away as relatively small bubbles. These small bubbles produce a higher frequency tone or note and upon eventual collapse behind the underwater vehicle 11 create less audible noise.

Propellors, or the like, are generally used to propel the underwater vehicle 11 through the water. The exhaust gas 13 is a byproduct of the combustion process that drives the propellors and must be expelled from the vehicle 11. Prop wash 36 from the propellors flows over the strainer 32 and the exhaust gas 13 mixes with the prop wash in the manner described above to form the relatively small bubbles.

Thus there has been described a new and improved muffler for use with underwater vehicles that produces less noise than conventional sound attenuating devices and also improves propulsion efficiency. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An exhaust system for releasing exhaust gases generated by the propulsion means of an underwater vehicle, said exhaust gases being released under water at the aft end of the vehicle, said exhaust system having relatively low noise emission, said exhaust system comprising:

an exhaust valve disposed at the aft end of the vehicle for receiving the exhaust gas, the exhaust valve having an outer wall having openings therein that permit exhaust gas to flow therethrough into the water;

a contoured strainer member disposed exterior to the exhaust valve and having an exterior surface, the exterior surface of the strainer having a contour that matches the contour of the vehicle and that provides for hydrodynamic flow of water along the vehicle and the strainer member as the vehicle is propelled through the water, the strainer member having a plurality of openings in the exterior surface, said openings being relatively small compared to the openings in said outer wall of the exhaust valve, said relatively small openings causing the formation of relatively small bubbles in the water when the exhaust gas is expelled therethrough.

2. A muffler for use with an underwater vehicle that minimizes noise emission from the vehicle, and wherein the vehicle includes a housing and an exhaust valve disposed at an aft end of the vehicle that is adapted to expel exhaust gas produced by the vehicle, said muffler comprising:

an exhaust valve that comprises relatively large openings disposed in an outer wall thereof that permit exhaust gas to flow therethrough into the water;

a contoured member secured to the aft end of the vehicle that has an exterior surface contour that matches the contour of the vehicle and that provides for hydrodynamic flow of water around the vehicle as it is propelled through the water, and wherein the contoured member has a plurality of relatively small openings in its exterior surface that cause the exhaust gas to form relatively small bubbles in the water as the exhaust gas escapes therefrom.

3. An exhaust system for releasing exhaust gases generated by the propulsion means of an underwater vehicle, said exhaust gases being released under water at the aft end of the vehicle, said exhaust system having relatively low noise emission, said exhaust system comprising:

an exhaust valve disposed at the aft end of the vehicle for receiving the exhaust gas, the exhaust valve having an outer wall having openings therein that permit exhaust gas to flow therethrough into the water;

a strainer member disposed exterior to the exhaust valve and having an exterior surface, the strainer member having a plurality of openings in the exterior surface, said openings being relatively small compared to the openings in said outer wall of the exhaust valve, said relatively small openings causing the formation of relatively small bubbles in the water when the exhaust gas is expelled therethrough.

4. An exhaust system as recited in claim 1 wherein said exhaust valve is cylindrical in shape and is disposed parallel to the longitudinal axis of said underwater vehicle.

5. An exhaust system as recited in claim 2 wherein said exhaust valve is cylindrical in shape and is disposed parallel to the longitudinal axis of said underwater vehicle.

6. An exhaust system as recited in claim 3 wherein said exhaust valve is cylindrical in shape and is disposed parallel to the longitudinal axis of said underwater vehicle.

7. An exhaust system as recited in claim 1 wherein the openings in said strainer member are in the range of 0.032 to 0.160 inches in diameter.

* * * * *